US005147072A

United States Patent [19]

Dirksing

[11] Patent Number: 5,147,072

[45] Date of Patent: Sep. 15, 1992

[54] TOGGLE CLOSURE WHICH PERMITS UNINTERRUPTED GLUG-FREE POURING FROM A RESILIENTLY DEFORMABLE CONTAINER

[75] Inventor: Robert S. Dirksing, Cincinnati, Ohio

[73] Assignee: The Procter & Gamble Company, Cincinnati, Ohio

[21] Appl. No.: 719,455

[22] Filed: Jun. 24, 1991

[51] Int. Cl.[5] ..... B65D 37/00

[52] U.S. Cl. ..... 222/212; 222/484; 222/485; 222/488; 222/536; 222/556; 239/327; 239/436

[58] Field of Search ..... 222/212, 211, 215, 481.5, 222/482, 484, 485, 486, 499, 531, 532, 533, 536, 537, 556, 545, 488; 239/327, 436; 215/309

[56] References Cited

U.S. PATENT DOCUMENTS

| | | | |
|---|---|---|---|
| 2,812,120 | 11/1957 | Beall, Jr. | 222/481.5 |
| 2,981,447 | 4/1961 | Jennings | 222/484 |
| 3,059,816 | 10/1962 | Goldstein | 222/484 X |
| 3,399,811 | 9/1968 | Miller | 222/484 X |
| 3,542,256 | 11/1970 | Waterman | 222/484 |
| 3,655,105 | 4/1972 | Johns | 222/484 |
| 3,734,359 | 5/1973 | Waterman | 222/484 |
| 4,241,855 | 12/1980 | Yoshioka | 222/536 X |
| 4,487,342 | 12/1984 | Shy | 222/481.5 |
| 4,645,086 | 2/1987 | Rosenthal | 215/235 |
| 4,678,107 | 7/1987 | Ennis, III | 222/386.5 |
| 4,717,050 | 1/1988 | Wright | 222/532 X |
| 4,732,303 | 3/1988 | Wang | 222/484 |
| 4,776,501 | 10/1988 | Ostrowsky | 222/517 |
| 4,782,985 | 11/1988 | Kinsley | 222/484 X |
| 4,838,460 | 6/1989 | Moore et al. | 222/153 |
| 4,962,869 | 10/1990 | Gross et al. | 222/153 |
| 4,982,882 | 1/1991 | Gueret | 222/531 |
| 5,002,209 | 3/1991 | Goodall | 222/481.5 X |

FOREIGN PATENT DOCUMENTS

| | | | |
|---|---|---|---|
| 323779 | 7/1989 | European Pat. Off. | 222/537 |
| 386475 | 9/1990 | European Pat. Off. | 222/536 |

*Primary Examiner*—Gregory L. Huson
*Attorney, Agent, or Firm*—E. Kelly Linman; T. H. O'Flaherty; R. C. Witte

[57] ABSTRACT

A toggle closure for a resiliently deformable container which provides substantially continuous, uninterrupted, glug-free dispensing of liquid products. The toggle closure has two conduits, the first of which comprises a liquid discharge conduit that will always dispense liquid upon inversion of the container and the second of which comprises a vent conduit that will either dispense liquid if the container is undergoing resilient deformation tendency toward collapse during liquid dischage or, alternatively, vent air into the container during liquid dispensing if the container is not undergoing resilient deformation tendency toward collapse during liquid discharge.

17 Claims, 3 Drawing Sheets

TOGGLE CLOSURE WHICH PERMITS UNINTERRUPTED GLUG-FREE POURING FROM A RESILIENTLY DEFORMABLE CONTAINER

BACKGROUND OF THE INVENTION

Toggle closures are commonly used for dispensing creams, lotions, and other thick liquids from resilient containers. Toggle closures offer consumer recognized conveniences over simple threaded closures. For example, toggle closures permit one handed manipulation with a simple one finger push-to-open and push-to-close operation. When used with creams and lotions, the common means to dispense is to squeeze the resilient container. Hence, toggle closures of the type generally known in the art have been suitable for dispensing small quantities of these products upon each operation. However, using such prior art toggle closures to dispense larger quantities of thinner liquids produces an undesirable result. Bi-directional flow through a common conduit produces severe glugging, splattering and slow dispensing. Squeezing the resilient container can overcome the glugging problem, but may be cumbersome with larger containers. In addition, multiple squeezes of the container may be required.

With larger liquid containers, for example, 40 ounces or more, the liquid head pressure may also be sufficient to cause resilient collapsing of the container as the liquid is dispensed. The resilient collapsing will provide partial glug-free dispensing but when the vacuum created by dispensing of the liquid is insufficient to cause further collapsing of the container, glugging will occur.

Providing a second conduit for venting air into the container during dispensing will eliminate glugging. Toggle or pivotable type closures which would satisfy this requirement are known in the art. For example, U.S. Pat. No. 3,734,359 issued to Waterman on May 22, 1973 admits atmospheric pressure through an air vent opening when a pivotable element is in the open position for dispensing. U.S. Pat. No. 4,487,342 issued to Shy on Dec. 11, 1984 discloses a toggle closure having an air intake path which admits ambient air to provide a smooth discharge flow of fluid from an effluent pipe and toggle port.

However, in both of the aforementioned U.S. Pat. Nos. 3,734,359 and 4,487,342, the air vent is intended for use only as an air vent. In both cases, the air vent path from the container opens into a chamber in the closure. Resilient collapsing of the container would result in flooding of the air path and liquid flow into the generally open chamber, which is necessarily open to provide the required venting. This flooding would result in severe leakage of the container's liquid contents from the closure. Once flooded, there would be little differential liquid head pressure available to cause the air vent to return to its intended function, and the container would have to be returned to an upright position and the liquid dispensing cycle stopped to clear the vent. As thin wall plastic is becoming more and more common in container structures, tolerance to container collapsing or squeezing, whether intended or inadvertent, is highly desirable.

OBJECTS OF THE INVENTION

It is therefore an object of the present invention to provide an improved toggle closure for a resilient container which will permit substantially glug-free dispensing of the container's liquid contents by means of a pair of conduits, one of which is specifically intended as a discharge flow path for the container's liquid contents and the other of which is intended to serve either as a discharge flow path for the container's liquid contents if the resilient container undergoes collapsing during the liquid dispensing cycle or as a vent path if the resilient container resists collapsing during the liquid dispensing cycle.

It is another object of the present invention to provide, in a preferred embodiment, such an improved toggle closure wherein both conduits are sealed at a location intermediate the interior openings into the container and the outlet of the toggle member of the closure when the toggle member is in its closed condition to prevent liquid leakage.

It is another object of the present invention to provide, in a particularly preferred embodiment, such an improved toggle closure having a common outlet location for the liquid discharge and vent conduits when the toggle member of the closure is in its open condition.

It is another object of the present invention to provide such an improved toggle closure for a resilient container which provides substantially glug-free dispensing of liquid from the container without squeezing or collapsing of the resilient container during the liquid dispensing cycle.

A further object of the present invention is to provide such an improved toggle closure for a resilient container which will accommodate both collapsing and non-collapsing of the resilient container during a single, continuous, uninterrupted, substantially glug-free liquid dispensing cycle.

DISCLOSURE OF THE INVENTION

In a particularly preferred embodiment, the present invention comprises a toggle closure for a resilient container which provides convenient, uninterrupted, substantially glug-free dispensing of any desired quantity of the liquid product housed in said resilient container. The toggle closure comprises a cap member which is sealingly engaged to the resilient container and a toggle member secured to the cap member so that it can pivot to either a closed or an open position with the application of finger pressure to the rear or the forward portions, respectively, of the toggle member.

The cap member is preferably provided with a base sealing plate having a liquid discharge tube which projects upwardly and outwardly therefrom. The interior surface of the base plate seats against the lip of the resilient container to form a liquid tight seal when the closure is firmly applied to the container.

The base sealing plate further includes a vent tube which extends both downwardly from the base sealing plate into the resilient container and upwardly and outwardly to about the same elevation as the liquid discharge tube. The toggle member is preferably provided with a liquid discharge channel and a vent channel which mate with the upwardly and outwardly extending portions of the liquid discharge tube and the vent tube, respectively.

The liquid discharge tube in the cap member and the liquid discharge channel in the toggle member combine to form a substantially continuous liquid discharge conduit when the toggle member is in its open position. The vent tube in the cap member and the vent channel in the toggle member also combine to form a substantially continuous vent conduit when the toggle member is in its open condition.

The liquid discharge conduit and the vent conduit are preferably combined with one another at the toggle member outlet port or at a point intermediate the toggle member outlet port and the uppermost ends of the liquid discharge and vent tubes. Combining the liquid discharge conduit and the vent conduit with one another upstream of the outlet port in the toggle member provides a common location for discharge of the liquid being dispensed regardless of whether liquid is being discharged from one or both conduits. This makes directional control of the liquid being discharged easier.

BRIEF DESCRIPTION OF THE DRAWINGS

While the specification concludes with claims particularly pointing out and distinctly claiming the present invention, it is believed the present invention will be better understood from the following description in conjunction with the accompanying drawings in which:

DETAILED DESCRIPTION OF THE INVENTION

Figure 1:
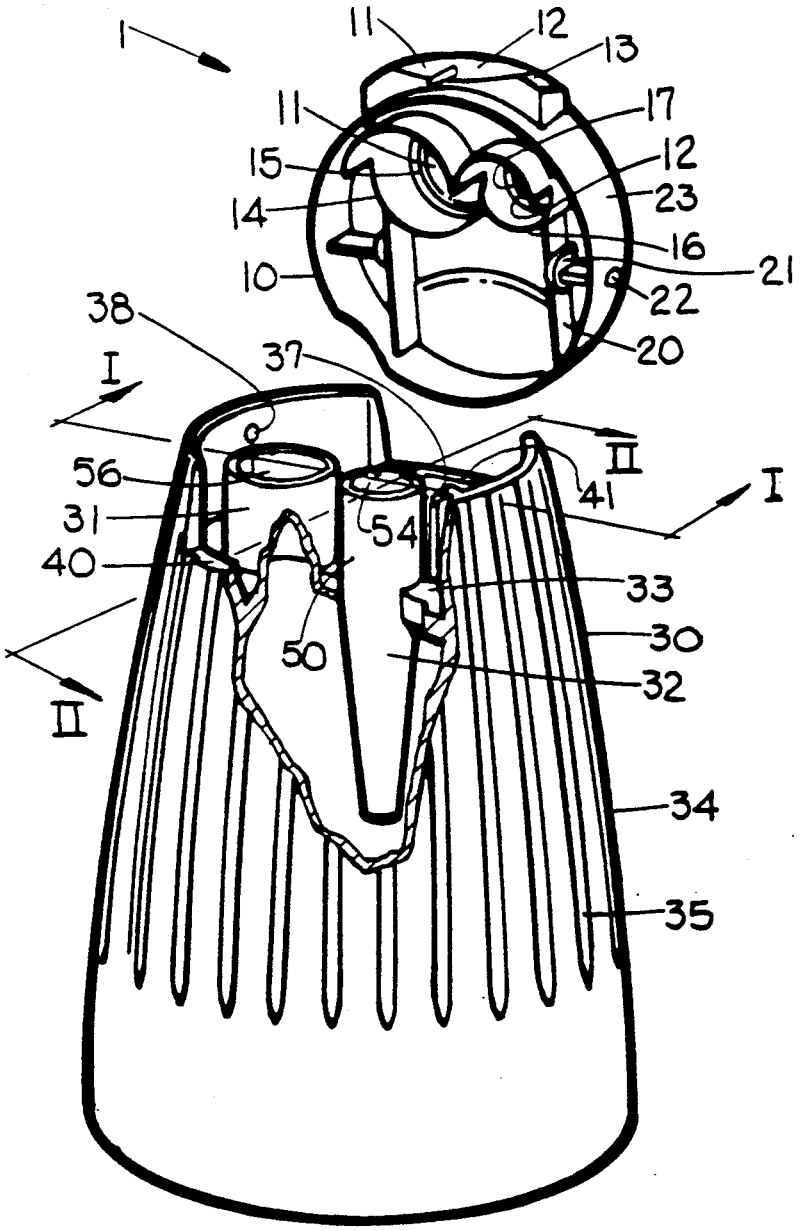
FIG. 1 is an exploded, simplified perspective view of a two part toggle closure of the present invention with the toggle member partially broken away to reveal the liquid discharge channel and the vent channel and the cap member partially broken away to expose the discharge tube and the vent tube, said toggle member being rotated upwardly so as to expose the inlets to the mating discharge channel and vent channel.

In FIG. 1 there is shown a particularly preferred toggle closure 1 of the present invention. Toggle closure 1 comprises a toggle member 10 and a cap member 30. Toggle member 10 may be integrally molded by means well known in the art from a thermoplastic material, such as polypropylene, polyethylene, or the like. Toggle member 10 comprises a liquid discharge channel 11, a seal ring 14, a plug seal 15, a vent channel 12, a seal ring 16, a plug seal 17, and an outlet port 13. Toggle member 10 further comprises a pair of ribs 20 which support a pair of opposed pivots 21. A pair of bosses 22 which are concentric with the pivots 21 project outwardly from the perimeter surface 23 of toggle member 10.

Figure 5:
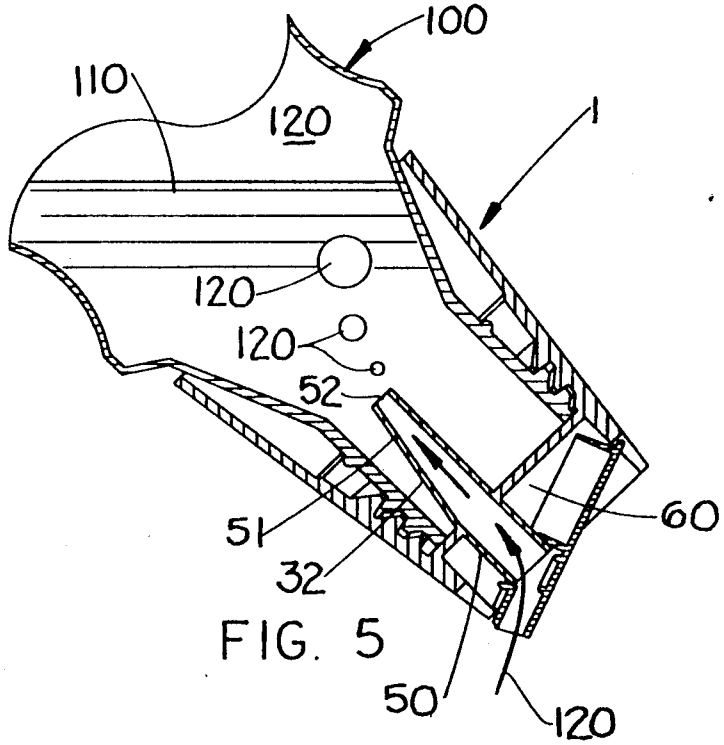
FIG. 5 is a simplified cross-sectional view generally similar to FIG. 4, but illustrating how, on occasion, air is vented through the vent conduit and into the container during a liquid dispensing cycle.
Figure 4:
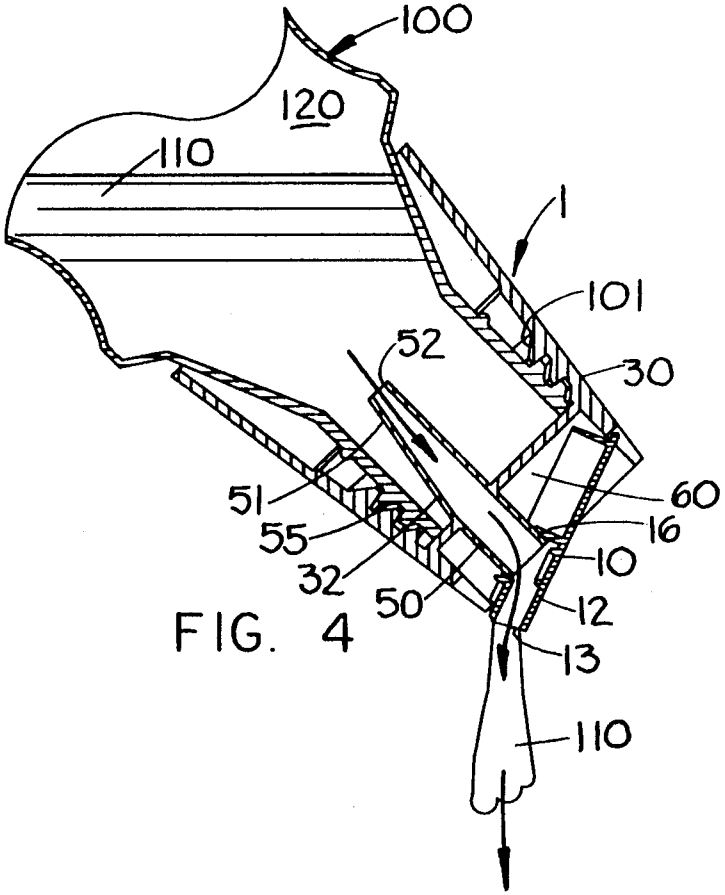
FIG. 4 is a cross-sectional view generally similar to that of FIG. 3, but showing the toggle closure attached to a resilient bottle which has been rotated to a dispensing position with its toggle member in an open condition, said view illustrating how liquid may be dispensed through the vent conduit during a liquid dispensing cycle.

Cap member 30 comprises a liquid discharge tube 31 and a vent tube 32 which are secured to a base sealing plate 33, the lowermost surface of which, in use, forms a liquid tight seal with a resilient container housing the liquid to be dispensed. Cap member 30 further comprises a skirt 34 having internal means, such as a helical thread 55 shown in FIG. 2, for releasably securing the closure member 30 to a resilient container. Grooves 35 about the exterior surface of skirt 34 serve to increase friction when either applying or removing toggle closure 1 to or from a resilient container such as a plastic bottle 100 having a threaded finish, as generally shown in FIGS. 4 and 5.

Figure 3:
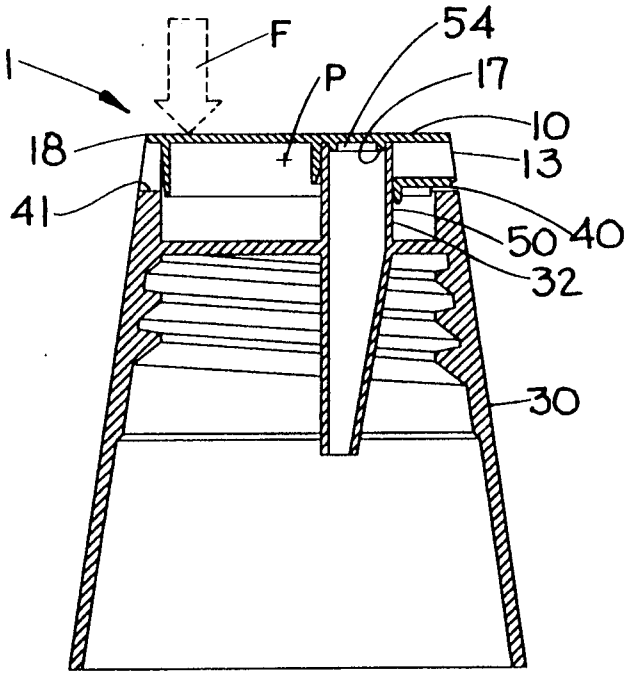
FIG. 3 is a simplified cross-sectional view of an assembled toggle closure of the type generally shown in FIG. 1 with the toggle member in its closed condition, said view being taken at a point corresponding to section line II—II of FIG. 1.

Cap member 30 further comprises a pair of pivotal bearing means, such as ribs 37, which engage pivots 21 on toggle member 10 in order to provide an axis of rotation "P", as shown in FIG. 3. Axis of rotation "P" permits toggle member 10 to rotate relative to cap member 30. A pair of detents 38 are preferably provided on cap member 30 to engage bosses 22 when toggle member 10 is snapped into position on cap member 30. This method of assembly pivotally secures the toggle member 10 to cap member 30.

Notch 40 in skirt 34 provides clearance for outlet port 13 on toggle member 10, while notch 41 in skirt 34 provides clearance for the finger of the user when the toggle member 10 is manually pivoted to its open condition.

Cap member 30 may be integrally molded by means well known in the art from a thermoplastic material, such as polypropylene, polyethylene, or the like.

Figure 2:
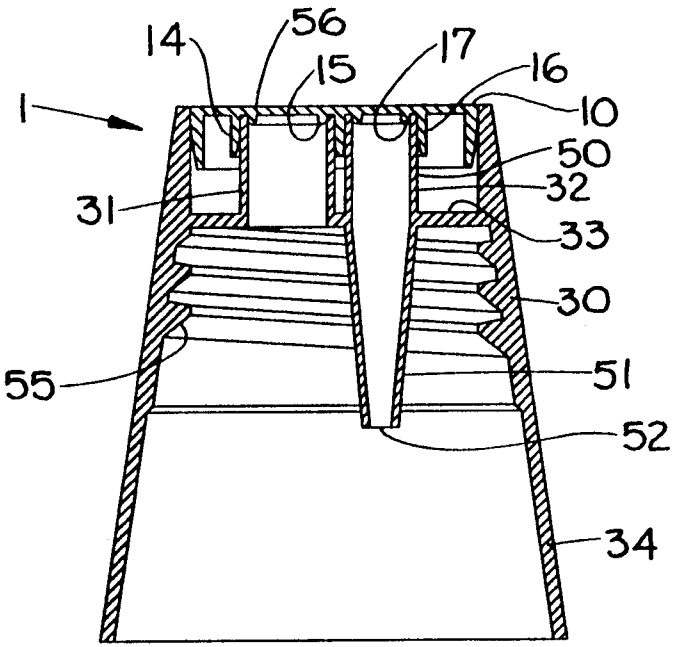
FIG. 2 is a simplified cross-sectional view of an assembled toggle closure of the type generally shown in FIG. 1 with the toggle member in its closed condition, said view being taken at a point corresponding to section line I—I of FIG. 1.

Referring to FIG. 2, which is a cross-sectional view of an assembled toggle closure 1 of the type shown in FIG. 1 taken at a point corresponding to section line I—I of FIG. 1, vent tube 32 comprises an uppermost portion 50 which extends upwardly and outwardly above the base sealing plate 33 and a lowermost portion 51 which extends below the base sealing plate 33. The lowermost portion 51 of vent tube 32 tapers in diameter to form a choke aperture 52, which is smaller in cross-section than the aperture 54 provided at the uppermost end of vent tube 32.

Liquid discharge tube 31 is of substantially constant cross-section and exhibits an aperture 56 at its uppermost end, said aperture 56 being larger in cross-section than aperture 54 in vent tube 32. Liquid discharge tube 31 extends upwardly and outwardly from the base sealing plate 33, as generally shown in FIGS. 1 and 2.

Toggle member 10 is shown in its closed condition in FIG. 2 so that plug seals 15 and 17 sealingly occlude the aperture 56 in liquid discharge tube 31 and the aperture 54 in the uppermost portion 50 of vent tube 32, respectively. Seal rings 14 and 16 surround and also help to seal the uppermost ends of the discharge tube 31 and the uppermost portion 50 of vent tube 32, respectively.

In the illustrated embodiment, it is generally preferred that liquid discharge channel 11 and vent channel 12 merge with one another to form a common flow passage prior to reaching outlet port 13 in toggle member 10. This permits easier directional control of the liquid exiting outlet port 13, regardless of whether liquid is being discharged through one or both conduits.

A helical thread 55 on the interior of skirt 34 is provided as a means to releasably engage toggle closure 1 with a complementary helical thread 101 on the outer periphery of the top of a resilient container 100, as generally shown in FIG. 4. Other suitable closure engaging means, e.g., snap fit beads, complementary lugs, etc., may be provided to releasably secure the toggle closure onto a resilient container 100 in a leaktight manner.

Alternatively, toggle closure 1 may, if desired, be non-releasably secured in leaktight relation to resilient container 100 or the cap member 30 may be integrally formed as part of the container. In the latter situation, an alternate means of introducing the liquid to be housed in the container is preferably provided.

Referring to FIG. 3, which is a cross-sectional view of an assembled toggle closure 1 of the type shown in FIG. 1 taken at a point corresponding to section line II—II of FIG. 1, plug seal 17 is sealingly engaged into the aperture 54 existing at the uppermost end portion 50 of vent tube 32. Outlet port 13 in toggle member 10 extends through notch 40 and terminates along a surface which is generally coincidental with a projection of the exterior surface of skirt 34 of cap member 30.

To open toggle closure 1 for dispensing, finger pressure is applied to the uppermost surface of toggle member 10 in the direction and at about the location indicated by the arrow "F" in FIG. 3. Applied force "F" causes toggle member 10 to rotate about axis of rotation "P". As toggle member 10 rotates, toggle extension 18 moves down through notch 41 and outlet port 13 moves upwardly through notch 40 until the fully open condition shown in FIGS. 4 and 5 is reached. Further, plug seals 15 and 17 disengage from apertures 56 and 54 of liquid discharge tube 31 and the uppermost portion 50 of vent tube 32, respectively.

FIGS. 4 and 5 show toggle closure 1 sealingly engaged in leaktight relation to a resilient container 100. Resilient container 100 may be molded by means well known in the art from a thermoplastic material, such as polyethylene terephthalate (PET), polypropylene, polyethylene, or the like.

In FIGS. 4 and 5, the toggle closure 1 is shown in its fully open condition. The liquid 110 in container 100 is in fluid communication with the atmosphere surrounding the container 100 via a vent conduit formed by the combination of vent tube 32 in cap member 30 and seal ring 16 and vent channel 12 in toggle member 10. The vent conduit connects choke aperture 52 in vent tube 32 and outlet port 13 in toggle member 10 with one another whenever the toggle member 10 is in its fully open position.

A similar liquid discharge conduit is formed whenever toggle member 10 is in its fully open position by the combination of liquid discharge tube 31 in cap member 30 and seal ring 14 and liquid discharge channel 11 in toggle member 10, thereby providing another passageway for fluid communication between the interior of resilient container 100 and the surrounding atmosphere via outlet port 13 in toggle member 10.

When toggle member 10 is in its fully open position, seal rings 14 and 16 continue to surround and seal about the peripheries of the uppermost ends of the liquid discharge tube 31 and the uppermost portion 50 of vent tube 32, respectively, so that liquid from container 100 cannot leak into the interior cavity 60 existing between cap member 30 and toggle member 10 when the toggle member 10 is in its fully open position, as generally shown in FIGS. 4 and 5.

In FIG. 4, resilient container 100 is shown undergoing resilient deformation tending toward collapse as liquid 110 is being dispensed. This is normally caused either by applied manual squeezing force to the container 100 or by the hydraulic head of the liquid 110 housed within container 100. Whenever resilient collapsing of container 100 during a dispensing cycle generates an outward flow of liquid 110 which exceeds the flow capacity of the liquid discharge tube 31, the liquid 110 in container 100 may additionally enter choke aperture 52 and flow outwardly through vent tube 32 in cap member 30, vent channel 12 in toggle member 10 and ultimately through outlet port 13, as indicated by the arrows.

Upon cessation of the resilient collapsing of container 100 shown in FIG. 4 or in the event resilient container 100 does not undergo collapsing when liquid 110 is being dispensed, substantially glug-free flow of liquid 110 from container 100 will continue uninterrupted for as long as desired through the liquid discharge conduit formed by the combination of liquid discharge tube 31 in cap member 30 and the seal ring 16 and liquid discharge channel 11 in toggle member 10, since air 120 is free to enter container 100 via the vent conduit formed by the combination of vent tube 32 in cap member 30 and the seal ring 14 and vent channel 12 in toggle member 10, as indicated by the arrows in FIG. 5. In the absence of resilient collapsing of container 100, the hydraulic head pressure differential of the liquid contents 110 within container 100 between the innermost ends of the vent tube 32 (which is located at the innermost end of lower portion 51) and the liquid discharge tube 31 (which is coincident with base sealing plate 33) when the package comprising the container 100 and the sealingly attached toggle closure 1 is rotated into a liquid dispensing position, produces a natural bias for the liquid 100 housed in container 110 to be dispensed from liquid discharge tube 31.

Choke aperture 52, which is located at the innermost end of lower portion 51 of vent tube 32 and which is smaller in cross-sectional area than either vent aperture 54 located at the uppermost end of vent tube 32 or liquid discharge aperture 56 located at the uppermost end of liquid discharge tube 56 restricts the flow of liquid 110 into the vent tube 32 during a dispensing cycle of the type shown in FIG. 4, i.e., when resilient container 100 is undergoing collapse. As can be seen from FIG. 4, the liquid 110 does not completely fill the vent conduit due to the restriction imposed by choke aperture 52. Thus, cessation of the resilient collapse of container 100 will cause an abrupt change in the flow condition shown in FIG. 4. In particular, the flow of liquid 110 through choke aperture 52 will cease, liquid 110 which is already within vent tube 32 will drain out of vent tube 32, and ambient air 120 will begin to enter container 100 through vent tube 32.

Intermittent collapsing and venting of resilient container 100, such as by manual squeezing, can result in alternating liquid dispensing and air venting through the vent conduit during a single, continuous dispensing cycle. The vent conduit formed by the combination of vent tube 32 in cap member 30 and seal ring 14 and vent channel 12 in toggle member 10 provides a continuous passageway from the interior of the resilient container 100 to the outlet port 13 in toggle member 10, said passageway being isolated from the liquid discharge conduit formed by liquid discharge tube 31 in cap member 30 and seal ring 16 and liquid discharge channel 11 in toggle member 10, at least until the point at which the separation between vent channel 12 and liquid discharge channel 11 is eliminated, i.e., a point located somewhere between seal rings 14 and 16 and outlet port 13, as shown in FIG. 1. Eliminating the separation between vent channel 12 and liquid discharge channel 11 in toggle member 10 in the foregoing manner ensures that when toggle member 10 is in its open position, any liquid 110 dispensed via the vent conduit is discharged from a common outlet port 13. This makes directional control of the discharged liquid easy to control regardless of whether the bottle is discharging liquid through vent tube 32 or allowing air to enter the container through vent tube 32.

While a particularly preferred embodiment of the present invention has been illustrated and described, it will be evident to those skilled in the art that various changes and modifications can be made without departing from the spirit and scope of the present invention, and it is intended to cover in the appended claims all such modifications that are within the scope of this invention.

What is claimed is:

1. A toggle closure for securement in sealed relation to the discharge orifice of a resiliently deformable container of liquid product, said toggle closure having a closed position for preventing the loss of said liquid product and an open position for substantially continuous, uninterrupted, glug-free dispensing of said liquid product from said resiliently deformable container, said toggle closure comprising in combination;

(a) a cap member comprising means to sealingly engage and secure said toggle closure to said resiliently deformable container, said cap member including a base sealing plate including a liquid discharge tube extending upwardly and outwardly from the outermost surface of said base sealing plate and a smaller vent tube extending inwardly from the innermost surface of said base sealing plate and upwardly and outwardly from the outermost surface of said base sealing plate, said cap member further including pivotal bearing means secured on the outermost surface of said base sealing plate, and (b) a toggle member having an outlet port and comprising pivoting means releasably engageable with said pivotal bearing means on said cap member, said toggle member including a liquid discharge channel in fluid communication with said outlet port and having means for sealingly engaging the uppermost end of said liquid discharge tube in said cap member in both the open and the closed condition of said toggle closure, said toggle member further including a vent channel in fluid communication with said outlet port and having means for sealingly engaging the uppermost end of said vent tube in said cap member in both the open and the closed condition of said toggle closure, said liquid discharge tube and said liquid discharge channel together forming a liquid discharge conduit and said vent tube and said vent channel together forming a vent conduit, each of said conduits placing the interior of said container in fluid communication with the surrounding atmosphere through the outlet port of the toggle member when said toggle member is in it its open condition, whereby inverting said container will cause said liquid in said resiliently deformable container to be simultaneously dispensed in a substantially continuous, uninterrupted, glug-free manner through said liquid discharge conduit and said vent conduit, if said container undergoes resilient deformation tending toward collapse as said liquid is being discharged, but discharge of said liquid through said vent conduit will cease and air will enter said container through said vent conduit while liquid continues to be dispensed in a substantially continuous, uninterrupted, glug-free manner through said liquid discharge conduit in the event said container does not undergo resilient deformation tending toward collapse as said liquid is being discharged.

2. The toggle closure of claim 1, wherein said means to sealingly engage and secure said toggle closure to said resiliently deformable container, comprises a helical thread engageable with a complementary helical thread located adjacent the discharge orifice of said resiliently deformable container.

3. The toggle closure of claim wherein the cross-sectional flow area of the innermost end of said vent tube is smaller than the cross-sectional flow area of the outermost end of said vent tube.

4. The toggle closure of claim 3, wherein said vent tube increases in cross-sectional flow area, as measured in a direction from its innermost end to said base sealing plate.

5. The toggle closure of claim 3, wherein the minimum cross-sectional flow area of said liquid discharge tube is greater than the maximum cross-sectional flow area of said vent tube.

6. The toggle closure of claim 5, wherein the cross-sectional flow area of said liquid discharge tube is substantially constant along its length.

7. The toggle closure of claim 1, wherein the liquid discharge channel portion of said liquid discharge conduit and the vent channel portion of said vent conduit merge with one another in said toggle member prior to reaching said outlet port.

8. The toggle closure of claim 1, wherein said pivoting means on said toggle member are releasably engaged with said pivotal bearing means on said cap member by means of a snap fit.

9. The toggle closure of claim 3, wherein said toggle member further includes a first seal ring at least partially surrounding the uppermost end of said vent tube and a second seal ring at least partially surrounding the uppermost end of said liquid discharge tube to provide liquid tight seals between said vent tube and said vent channel and between said liquid discharge tube and said liquid discharge channel, respectively, when said toggle member is in its open position.

10. The toggle closure of claim 9, wherein said toggle member further includes a first plug seal for sealing the uppermost end of said vent tube and a second plug seal for sealing the uppermost end of said liquid discharge tube when said toggle member is in its closed position.

11. The toggle closure of claim 3, wherein said toggle member resides totally within the profile of said cap member when said toggle member is in its closed position.

12. The toggle closure of claim 11, wherein said cap member further includes a notch complementary to said toggle member, whereby the user can move said toggle member from its closed to its open condition without interference from said cap member by pushing downwardly on the end of said toggle member which is opposite said outlet port with a single finger.

13. The toggle closure of claim 12, wherein said toggle member can be returned to its closed condition by pushing downwardly on the end of said toggle member including said outlet port with a single finger.

14. A toggle closure for securement in sealed relation to the discharge orifice of a resiliently deformable container of liquid product, said toggle closure having a closed position for preventing the loss of said liquid product and an open position for substantially continuous, uninterrupted, glug-free dispensing of said liquid product from said resiliently deformable container, said toggle closure comprising in combination;

(a) a cap member comprising means to sealingly engage and secure said toggle closure to said resiliently deformable container, said cap member including a base sealing plate including a liquid discharge tube extending upwardly and outwardly from the outermost surface of said base sealing plate and a vent tube extending inwardly from the innermost surface of said base sealing plate and upwardly and outwardly from the outermost surface of said base sealing plate, the innermost end of said vent tube exhibiting a smaller cross-sectional flow area than the outermost end of said vent tube, said liquid discharge tube exhibiting a larger minimum cross-sectional flow area than the maximum cross-sectional flow area of said vent tube, said cap member further including pivotal bearing means secured on the outermost surface of said base sealing plate, and (b) a toggle member having an outlet port and comprising pivoting means releasably engageable with said pivotal bearing means on said cap member, said toggle member including a liquid discharge channel in fluid communication with said outlet port and having means for sealingly engaging the uppermost end of said liquid discharge tube in said cap member in both the open and the closed condition of said toggle closure, said toggle member further including a vent channel in fluid communication with said outlet port and having means for sealingly engaging the uppermost end of said vent tube in said cap member in both the open and the closed condition of said toggle closure, said liquid discharge tube and said liquid discharge channel together forming a liquid discharge conduit and said vent tube and said vent channel together forming a vent conduit, each of said conduits placing the interior of said container in fluid communication with . the surrounding atmosphere through the outlet port of the toggle member when said toggle member is in it its open condition, whereby inverting said container will cause said liquid in said resiliently deformable container to be simultaneously dispensed in a substantially continuous, uninterrupted, glug-free manner through said liquid discharge conduit and said vent conduit if said container undergoes resilient deformation tending toward collapse as said liquid is being discharged, but discharge of said liquid through said vent conduit will cease and air will enter said container through said vent conduit while liquid continues to be dispensed in a substantially continuous, uninterrupted, glug-free manner through said liquid discharge conduit in the event said container does not undergo resilient collapse as said liquid is being discharged.

15. The toggle closure of claim 14, wherein the liquid discharge channel portion of said liquid discharge conduit and the vent channel portion of said vent conduit merge with one another in said toggle member prior to reaching said outlet port.

16. The toggle closure of claim 15, wherein said toggle member further includes a first seal ring at least partially surrounding the uppermost end of said vent tube and a second seal ring at least partially surrounding the uppermost end of said liquid discharge tube to provide liquid tight seals between said vent tube and said vent channel and between said liquid discharge tube and said liquid discharge channel, respectively, when said toggle member is in its open position.

17. The toggle closure of claim 16, wherein said toggle member further includes a first plug seal for sealing the uppermost end of said vent tube and a second plug seal for sealing the uppermost end of said liquid discharge tube when said toggle member is in its closed position.

* * * * *

UNITED STATES PATENT AND TRADEMARK OFFICE

CERTIFICATE OF CORRECTION

PATENT NO. : 5,147,072

DATED : September 15, 1992

INVENTOR(S) : ROBERT S. DIRKSING

It is certified that error appears in the above-identified patent and that said Letters Patent is hereby corrected as shown below:

Column 4, line 67, after "closure" insert -- 1 -- .

Column 6, lines 63-64, delete "a point located somewhere" and insert therefor -- in the area -- .

Column 8, line 12, after "claim" insert -- 1 -- .

Column 10, line 18, after "resilient" insert -- deformation tending toward -- .

Signed and Sealed this

Twenty-sixth Day of October, 1993

*Attest:*

Bruce Lehman

BRUCE LEHMAN

*Attesting Officer*

*Commissioner of Patents and Trademarks*